United States Patent [19]

Carver

[11] Patent Number: 5,042,660

[45] Date of Patent: Aug. 27, 1991

[54] COLLAPSIBLE DISPLAY CARRIER AND METHOD OF MAKING

[75] Inventor: Robert G. Carver, Ashland, Ohio

[73] Assignee: Coburn, Inc., Ashland, Ohio

[21] Appl. No.: 426,943

[22] Filed: Oct. 25, 1989

[51] Int. Cl.[5] ..... B65D 71/40

[52] U.S. Cl. ..... 206/434; 206/141; 206/149; 206/426; 229/40

[58] Field of Search ..... 206/140, 141, 148, 149, 206/161, 427, 426, 434; 229/40; 493/394, 405

[56] References Cited

U.S. PATENT DOCUMENTS

| | | | |
|---|---|---|---|
| 3,598,302 | 8/1971 | Nowak | 206/426 |
| 3,854,580 | 12/1974 | Hennessey | 206/426 |
| 4,640,417 | 2/1987 | Durand | 206/426 |
| 4,735,314 | 4/1988 | Kadleck et al. | 206/426 |
| 4,875,585 | 10/1989 | Kadleck et al. | 206/426 |

*Primary Examiner*—Jimmy G. Foster

*Attorney, Agent, or Firm*—Renner, Otto, Boisselle & Sklar

[57] ABSTRACT

A display carrier for glassware or the like is foldable from a generally flat, collapsed condition for shipping and storage to an erect position for retaining at least a pair of articles. The carrier is formed of a flexible material which forms a top wall, a bottom wall and a pair of side walls, each side wall being hinged to each of the top and bottom walls to form a carrier sleeve. A reinforcing wall extends between the top and bottom walls. Planar retaining tabs are resiliently connected along a fold line of the top and bottom walls, and each tab is contoured so that it can flex to match the volume swept out by a glass or other article as it is being inserted into the carrier. Bights in the reinforcing wall limit movement of the retaining tabs. When the carrier is folded flat, the reinforcing wall holds the tabs flat against the top and bottom walls to which they are hinged. The carrier may also include a lift tab which lifts the retaining tabs from the flat position against the top and bottom walls to a position in which they bear against a respective bight. The method of making the carrier from a blank is also disclosed.

27 Claims, 11 Drawing Sheets

FIG. 9
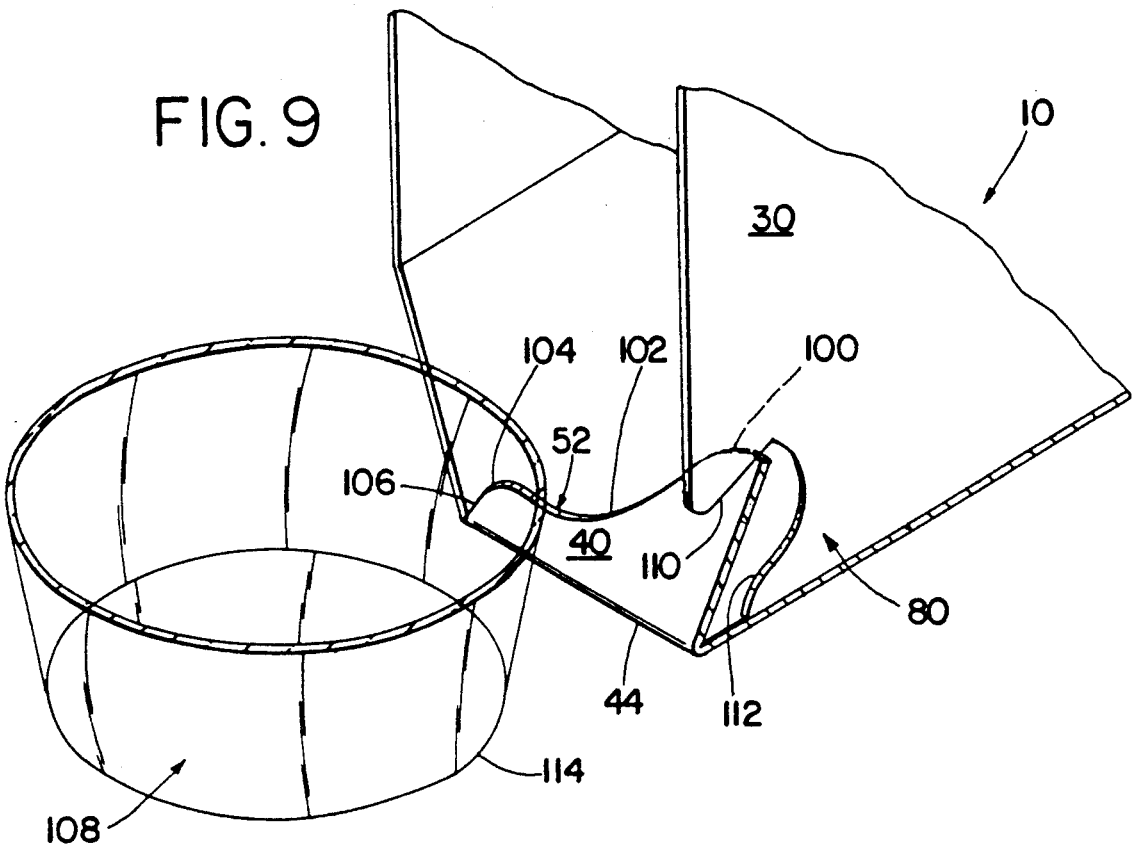
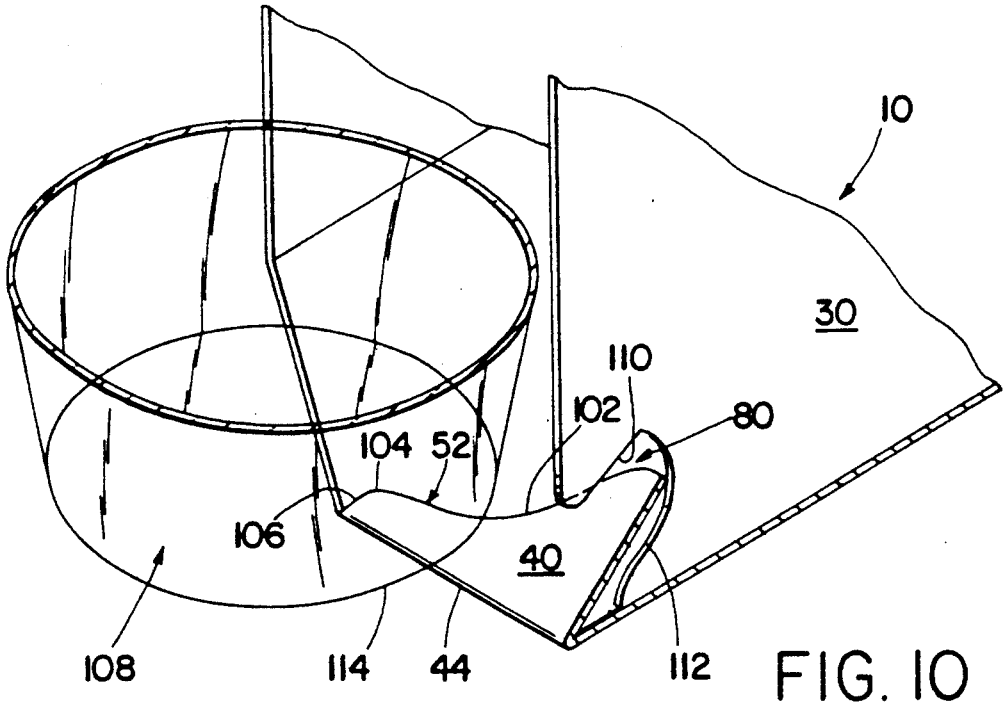
FIG. 10

COLLAPSIBLE DISPLAY CARRIER AND METHOD OF MAKING

FIELD OF THE INVENTION

The present invention relates to a display carrier which is easy to assemble and fill with articles to be displayed such as glassware.

BACKGROUND OF THE INVENTION

Glassware is frequently sold in cardboard containers which wrap around two, four or possibly more glasses and hold them without allowing them to clink together. Typically, the containers have a top, a pair of sides and a bottom joined together to form a sleeve surrounding the glasses. Glasses are put in the sleeve in a side-by-side arrangement. A reinforcing wall extends vertically from the top to the bottom to separate the pairs of glasses and to keep the bottom from sagging. Additional tabs keep the adjacent glasses of each pair from touching. When glassware is ready for shipping, a worker assembles the cardboard container and puts the appropriate number of glasses in it.

One such container is shown in U.S. Pat. No. 4,735,314 to Kadleck et al. The Kadleck et al container arrives at the glassware factory in a flattened state with retaining tabs extending outward from the top and bottom panels. In order to fill the container, a worker must erect it and insert the glassware. Once the glassware is in place, the worker must fold locking tabs at the top and bottom of the container through about a 135° angle and insert them into narrow slots in the reinforcing wall. Each narrow slot prevents the locking tab captured in the slot from moving in either direction. Manipulating the locking tabs into these narrow slots is time consuming and tiresome.

SUMMARY OF THE INVENTION

The present invention provides a display carrier which is substantially easier to use than the prior art carriers. Manual manipulation of the locking tabs is eliminated by a design which automatically positions the locking tabs as the carrier is erected. Specifically the present invention provides a central reinforcing panel with bights, and a tab is associated with each bight and hinged to the edge of the respective top or bottom panel along a fold line. The tab has a single contoured edge joining opposite ends of the fold line. The contoured edge is shaped to permit an article to slide over the tab when the carrier is in an erect position and to retain such an article in place once fully inserted.

BRIEF DESCRIPTION OF THE DRAWINGS

FIG. 9 is a perspective cutaway view of part of the carrier and part of a glass with a circular cross section prior to insertion into the carrier;

FIG. 10 is a view similar to FIG. 9 with the glass being inserted into the carrier;

DESCRIPTION OF PREFERRED EMBODIMENTS OF INVENTION

Figure 1:
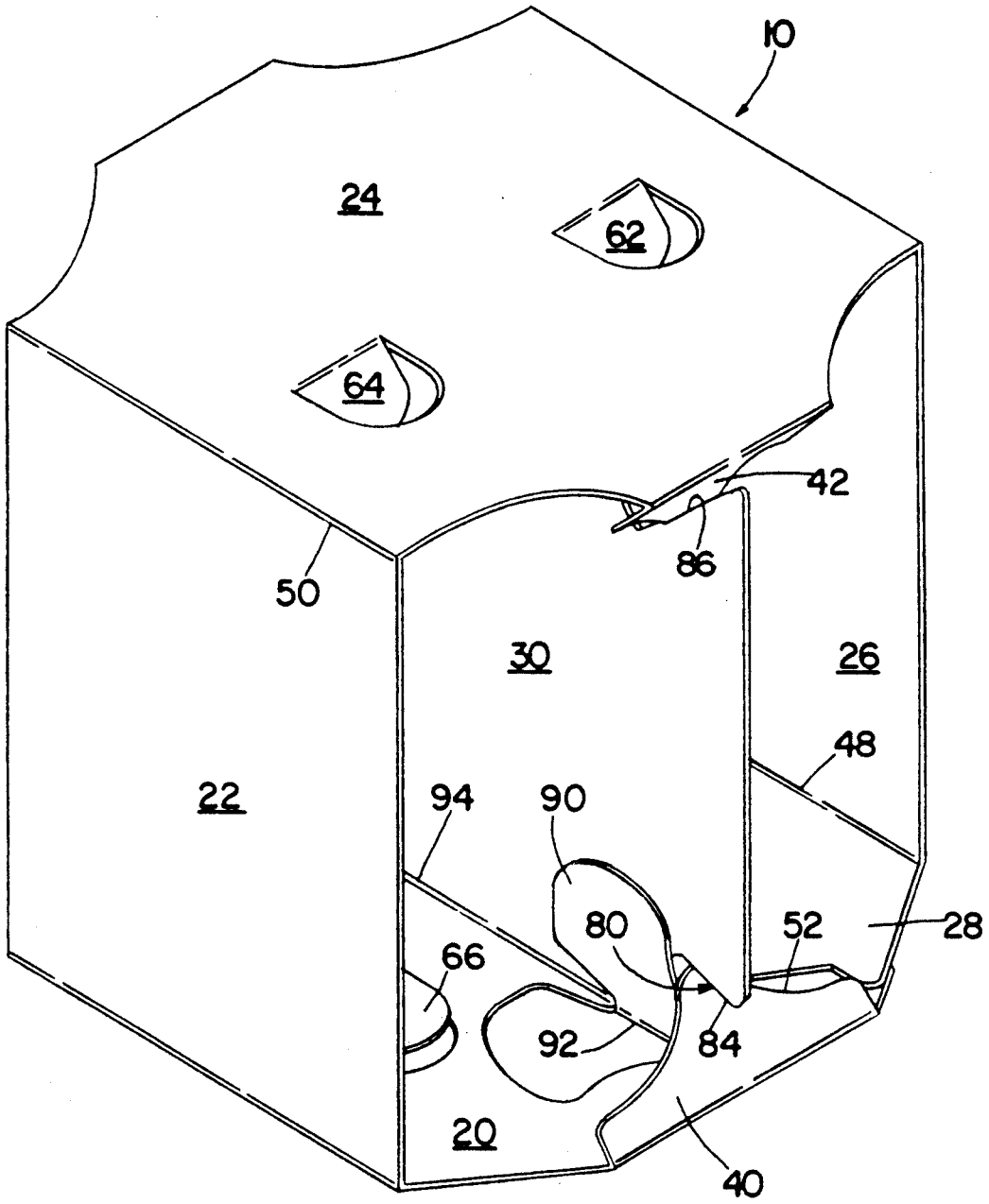
FIG. 1 is a perspective illustration of a carrier constructed in accordance with the present invention.
Figure 2:
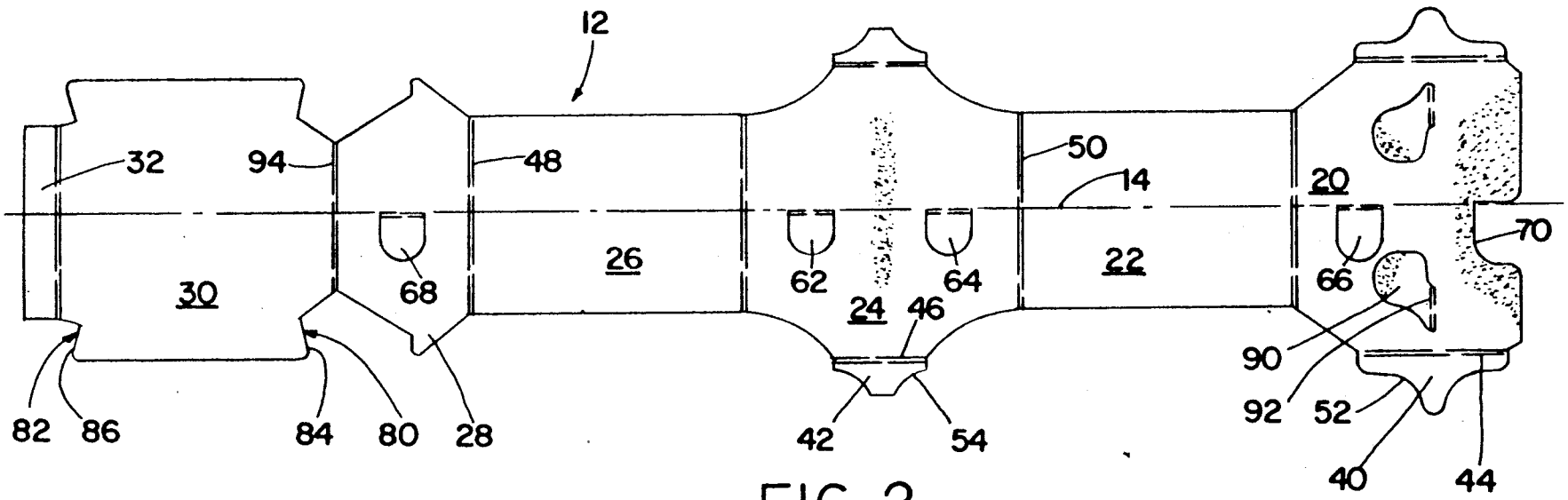
FIG. 2 is a plan view of a blank from which the carrier of FIG. 1 may be formed.

The carrier 10 shown in FIG. 1 is formed from a cardboard blank 12 illustrated in FIG. 2 on a conventional folding machine. The blank 12 is essentially symmetrical about its longitudinal center line 14, and accordingly only the front half of the blank 12 and carrier 10 will be described in detail. The asymmetries are specifically noted when appropriate.

The blank 12 includes (from right to left in FIG. 2) a bottom panel 20, a left side panel 22, a top panel 24, a right side panel 26, an overlap panel 28, a central reinforcing panel 30, and a glue flap 32. Each panel (and the glue flap) is connected to its adjacent panel or panels by creased fold lines which are perpendicular to the center line 14.

The blank 12 also includes a bottom retaining tab 40 and a top retaining tab 42 which extend from the bottom panel 20 and the top panel 24, respectively. The retaining tabs 40 and 42 are connected with their respective panels along creases or fold lines 44 and 46 which are parallel to the center line 14. The fold lines 44 and 46 also happen to be colinear with each other, but this is because the carrier 10 is designed for glassware that has a top and bottom of about the same diameter. When the glassware has a substantially non-cylindrical shape the fold lines 44 and 46 could be non-colinear. Each tab 40 and 42 has a contour along its free edge 52, 54, respectively, joining opposite sides of the fold line.

When in their operative positions (shown in FIG. 1), the retaining tabs 40 and 42 are effective to prevent the accidental or unintentional removal of glassware from the carrier 10.

Figure 3:
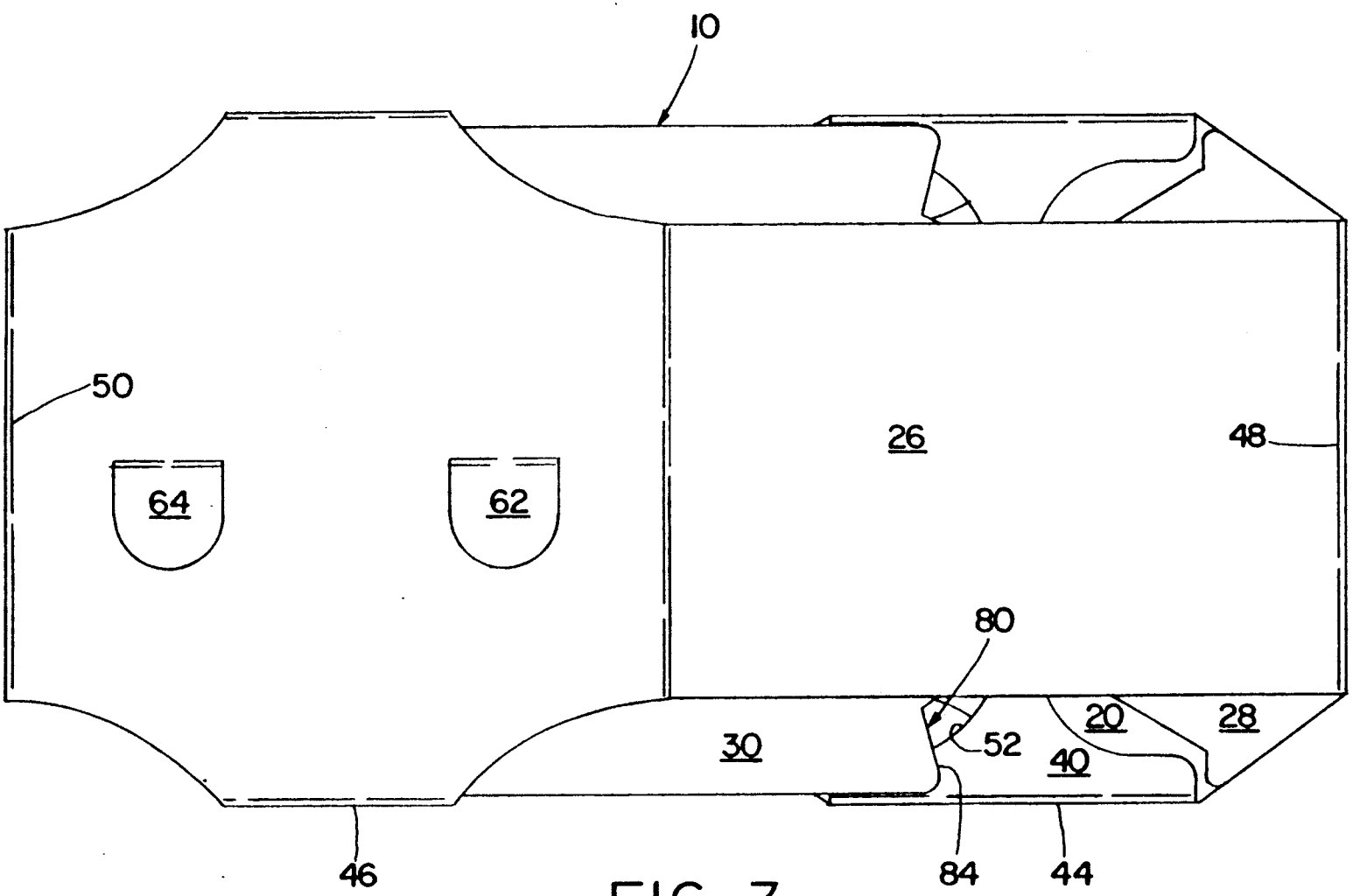
FIG. 3 is a plan view of the carrier of FIG. 1 in a collapsed condition.
Figure 4:
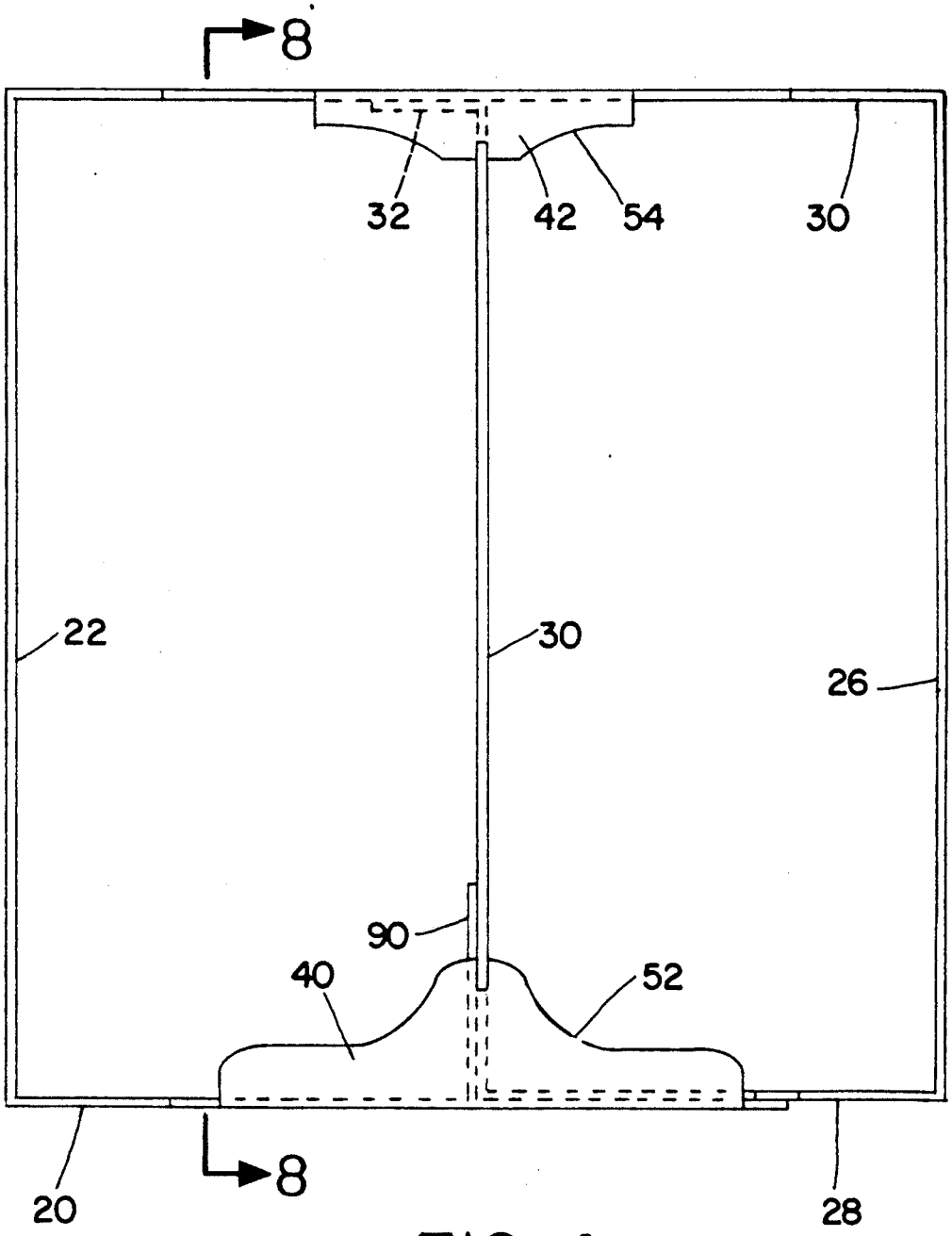
FIG. 4 is a front elevation view of the carrier of FIG. 1.

The carrier 10 is formed by first folding the retaining tabs 40 and 42 180° about the fold lines 44 and 46 until the tabs lie flat against their respective panels 20 and 24. Next, glue is applied to the areas shaded in FIG. 2 and the blank is then folded successively first about transverse fold line 48 and then about transverse fold line 50. These steps produce the collapsed carrier 10 shown in plan view in FIG. 3.

The carrier 10 may then be erected to the configuration shown in FIG. 1 by grasping the carrier and pressing the fold lines 48 and 50 toward each other. The result is the carrier 10 shown in FIG. 1 which defines a sleeve with the central reinforcing panel 30 dividing the carrier vertically in half.

Figure 7:
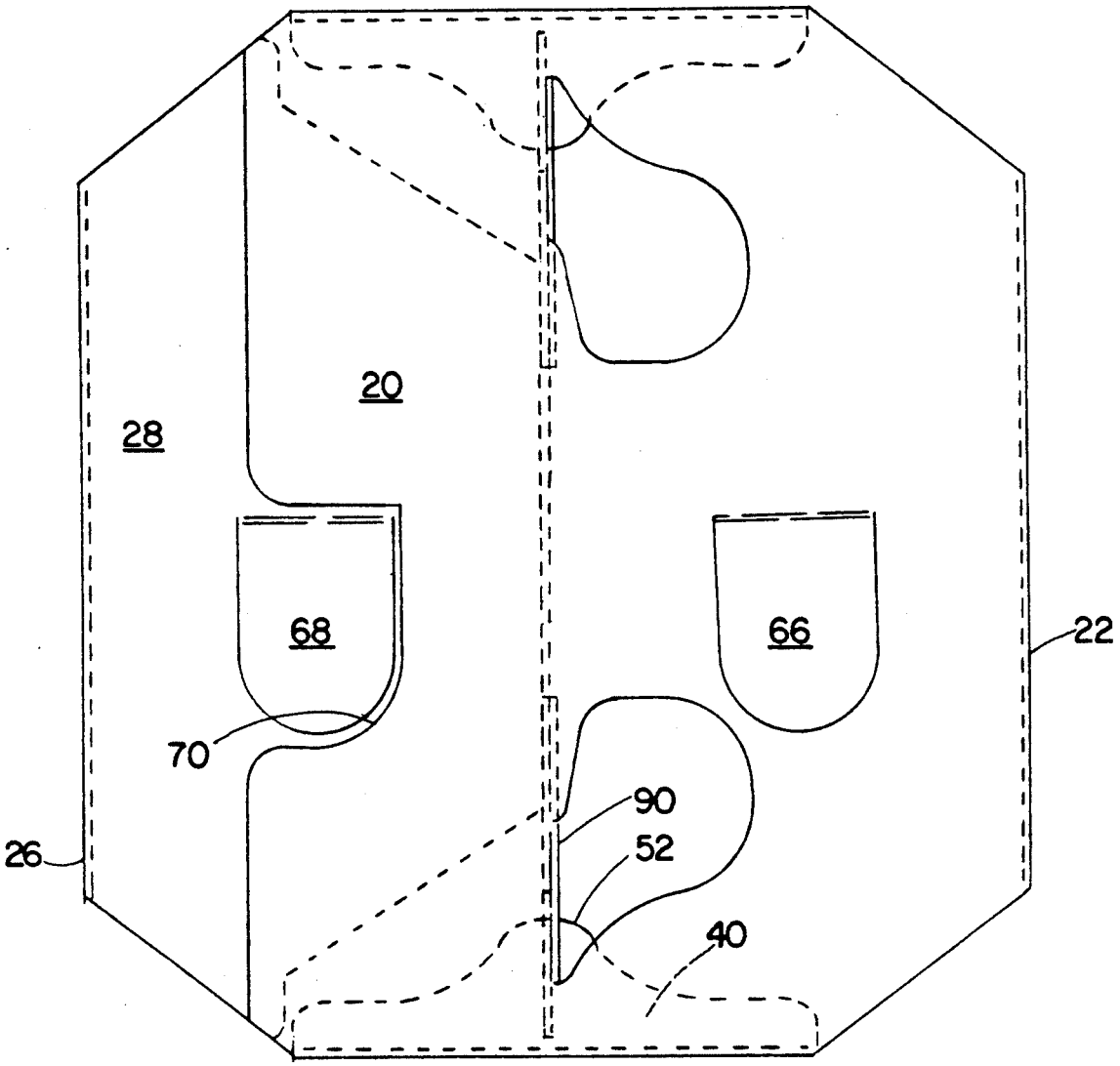
FIG. 7 is a bottom view of the carrier of FIG. 1.

The carrier 10 is proportioned to hold four glasses, two on each side of the central dividing panel 30, and this accounts for the only asymmetry of the blank 12 (FIG. 2). Tabs 62, 64, 66, and 68 are die cut into the top, bottom, and overlap panels 24, 20, and 28, respectively. These tabs are D shaped and hinged along creases which are coincident with the center line 14. When folded into the carrier 10 (FIG. 1) so that the plane of each tab is perpendicular to the panel to which it is hinged, the tabs prevent adjacent glasses on the same side of the central reinforcing panel 30 from clinking against each other. To permit a worker to push tab 68 out of the plane of the overlap panel 28, a cutout 70 (FIGS. 2 and 7) is formed in the edge of the bottom panel 20.

Figure 5:
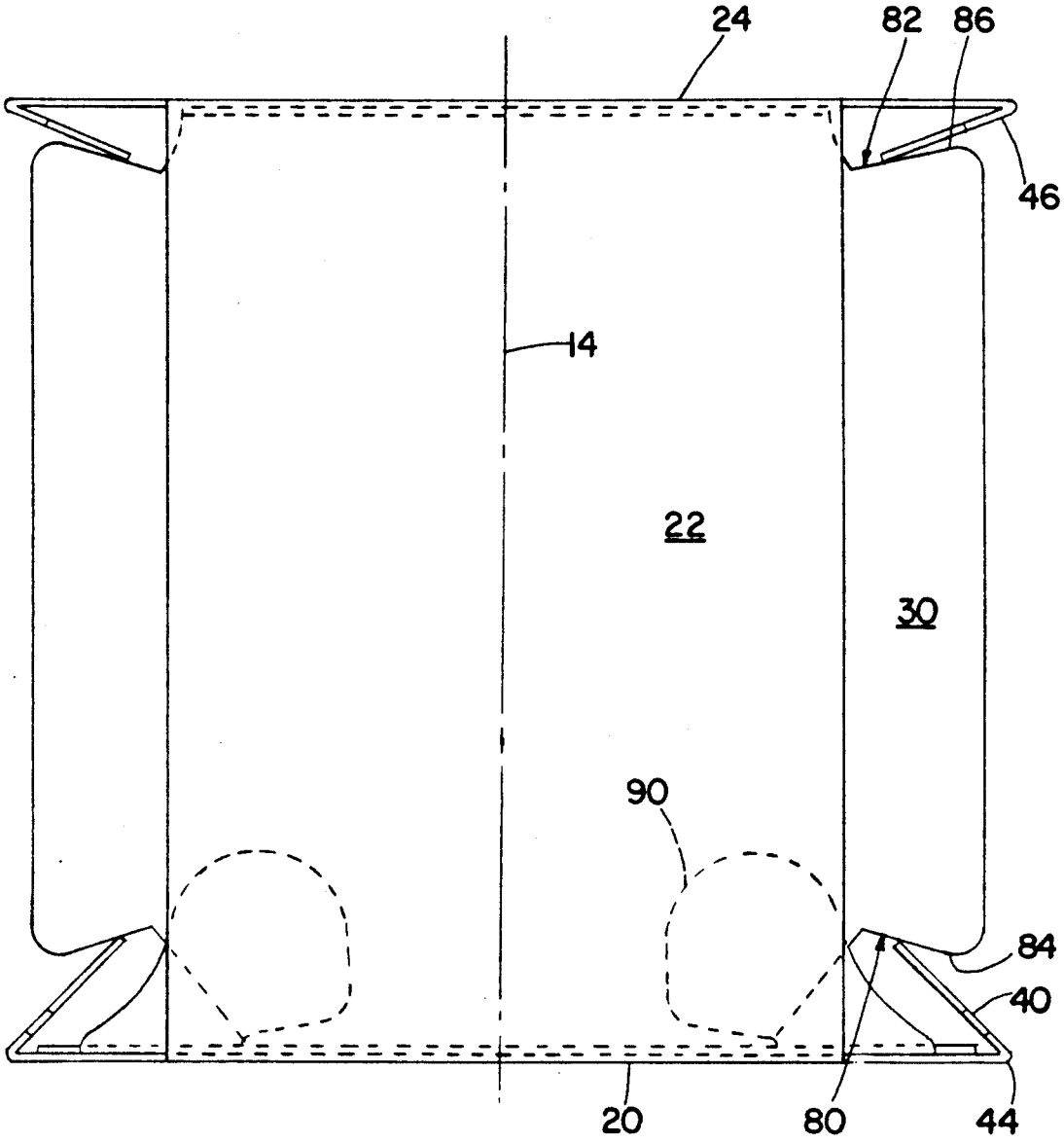
FIG. 5 is a left side elevation view of the carrier of FIG. 1.
Figure 6:
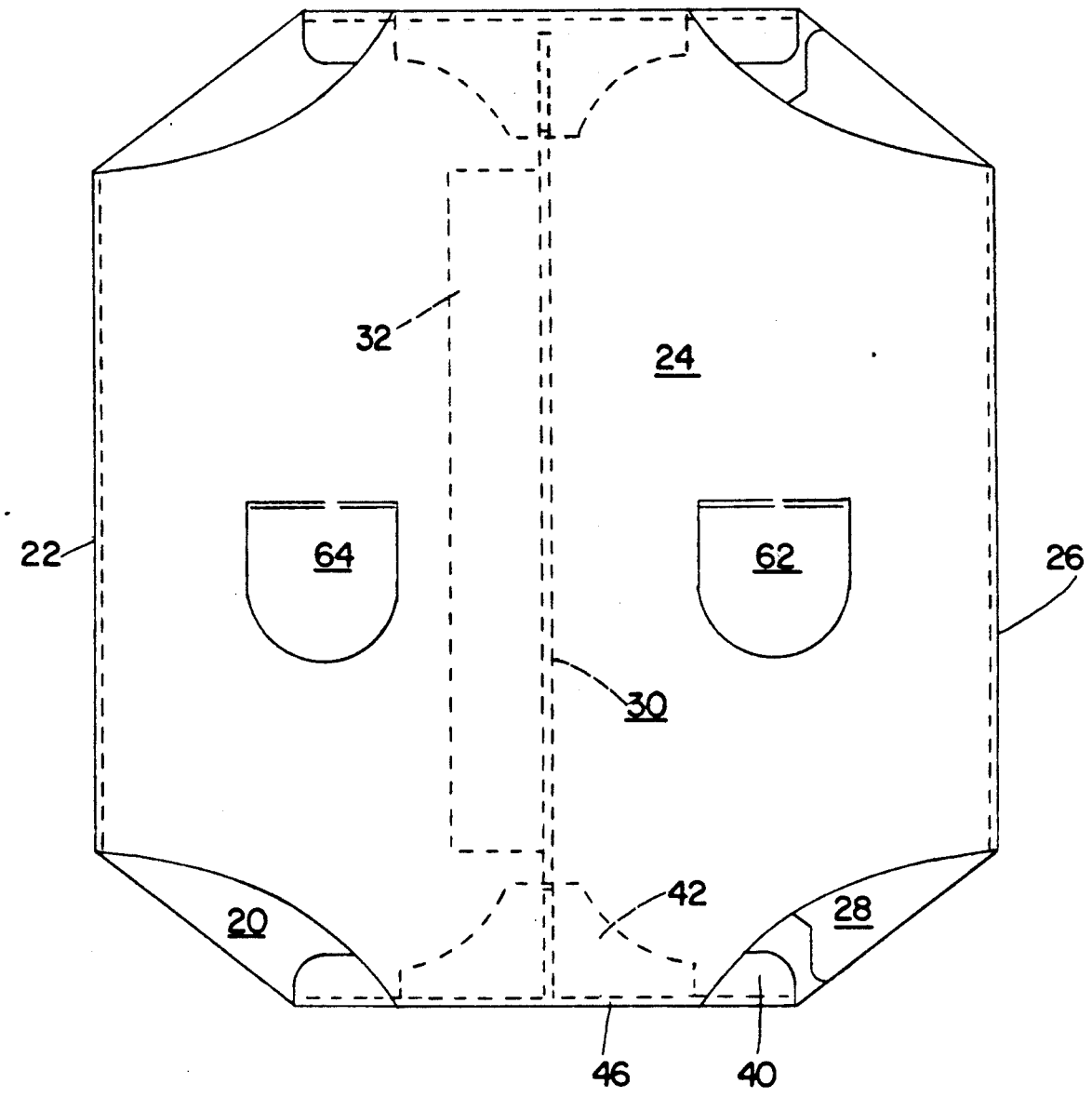
FIG. 6 is a top plan view of the carrier of FIG. 1.
Figure 8:
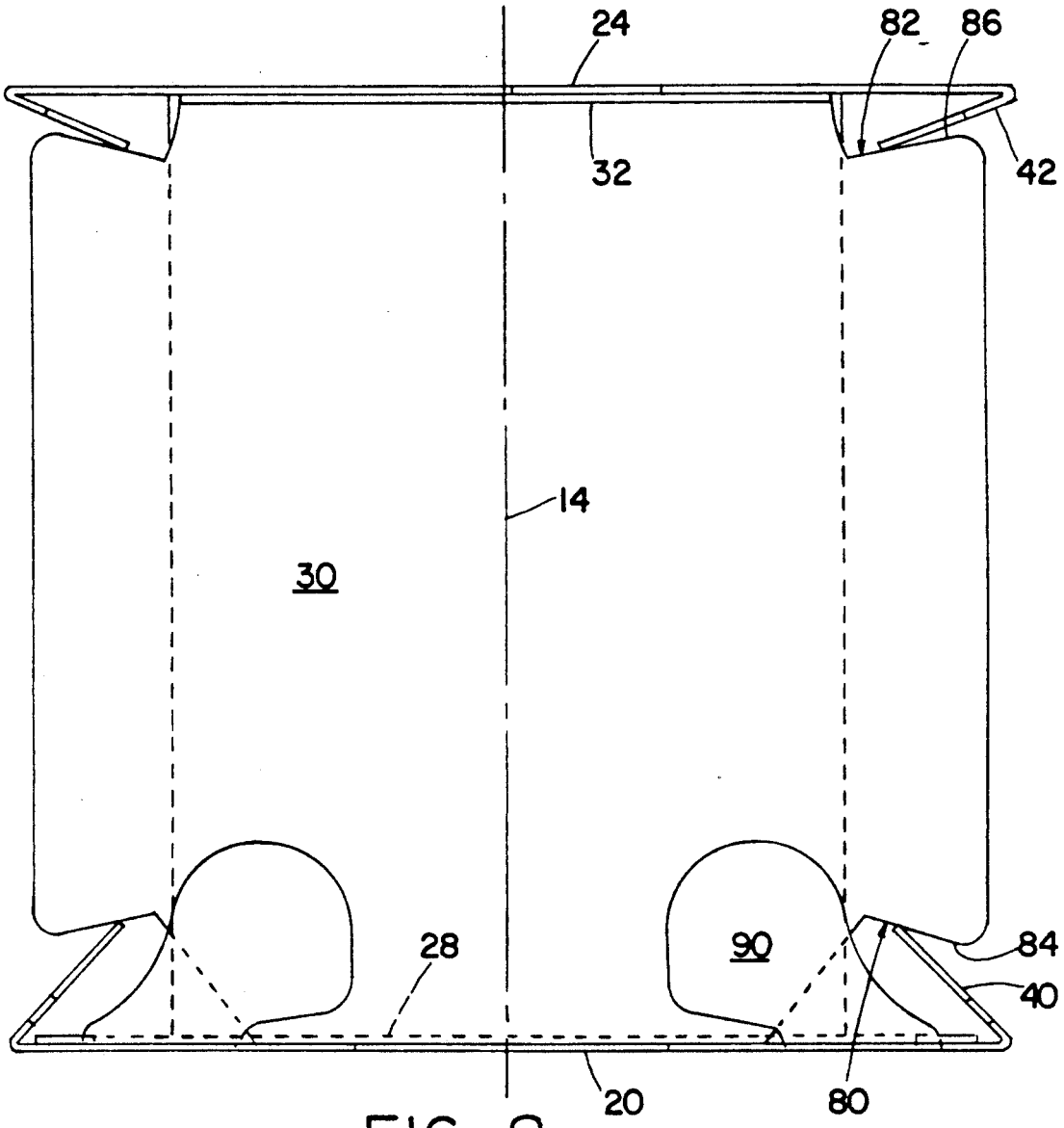
FIG. 8 is a section view looking generally in the direction of arrows 8—8 of FIG. 4.

The carrier 10 includes a unique arrangement and cooperation between the retaining tabs 40 and 42 and the bights 80 and 82 in the central reinforcing panel 30 with which the tabs 40 and 42 cooperate, respectively. After the carrier 10 is erected, each tab 40 and 42 contacts a straight line edge 84 and 86, respectively, which partially defines the respective bight. See FIGS. 1, 5, and 8. In this position the tabs 40 and 42 are effective to prevent withdrawal of a glass from the carrier 10.

The bights 80 and 82 are also shaped to facilitate assembly and erection of the carrier 10. When the blank 12 is first folded along fold lines 48 and 50, the resultant carrier is a flat, three-layer sandwich. Specifically, the right side panel 26 and the top panel 24 are coplanar (FIG. 3), the bottom panel 20 and left side panel 22 are also coplanar, and the central reinforcing panel 30 and overlap panel 28 are coplanar and sandwiched between the other four panels. When the carrier 10 is in the flattened position shown in FIG. 3, the edge 84 of the bight 80 in the central reinforcing panel 30 overlaps the contoured edge 52 of the retaining tab 40. At the same time the edge 86 of the bight 82 overlaps the contoured edge 54 of the retaining tab 40 in the same manner.

As noted above, the first step in folding the blank 12 to form the carrier 10 is to fold the retaining tabs 40 and 42 180° about fold lines 44 and 46. The tabs 40 and 42 are held in this position while the blank is bent about transverse fold lines 48 and 50. The overlapping by the central reinforcing panel 30 described above holds the retaining tabs 40 and 42 folded over until the carrier is erected. When the carrier 10 is erected from the collapsed state (FIG. 3) to the erect state (FIG. 1), the natural resilience of the cardboard causes the retaining tabs 40 and 42 to unfold slightly. This causes the tabs 40 and 42 to catch the edge of a glass and prevent the glass' removal.

The lower retaining tab 40 may not spring up from its folded flat arrangement to engage the bottom of a glass inserted in the carrier 10, depending on the shape of the glass. In order to ensure that the tab 40 unfolds satisfactorily, a lift tab 90 is provided.

The lift tab 90 is die cut from the bottom panel 20 and is shaped to fold along a transverse fold line 92. When the blank 12 is folded, the fold line 94 between the overlap panel 28 and the central reinforcing panel 30 aligns with the fold line 92. Glue previously applied to the tab 90 bonds the tab 90 to the central reinforcing panel.

When the carrier 10 is erected, the central reinforcing panel 30 pivots from being parallel to the bottom panel 20 to being perpendicular to it. Part of the lift tab 90 is underneath the retaining tab 40 when the carrier 10 is in the collapsed condition. Lifting the tab 90 by pivoting it about fold line 92 causes it to lift the retaining tab to an operative position where it will engage a glass and prevent its removal. Thus the act of erecting the carrier 10 pries the tab 90 out of the plane of the bottom panel and brings it to a perpendicular position.

A lift tab like lift tab 90 could also be provided to ensure proper positioning of the retaining tab 42, but it is generally not necessary because glassware generally has cylindrical side walls, near the open, top end. The lift tab 90 to position the lower retaining tab 40 is necessary because of the curved contour of the lower portion of the glassware which requires greater angular movement of the retaining tab 40 from its folded flat position.

When the carrier 10 is manufactured in automatic folding equipment, the creases along fold lines 44 and 46 may be compressed between rollers so firmly that the natural resilience of the cardboard does not allow the retaining tabs 40 and 42, respectively, to spring upward naturally. The lift tab 90 resolves this problem with respect to the lower retaining tab 40. Gravity and the slight remaining resilience of the top retaining tab 42 are sufficient to cause the upper retaining tab 42 to fall down into a glass retaining position.

To increase the resilience of the cardboard along fold lines 44 and 46, the pressure applied by the rollers in the folding machine can be reduced so that less of the cardboard is crushed at the fold. Alternatively, a lift tab like tab 90 could be provided for the upper retaining tab 42.

The contoured edge 52 of the bottom retaining tab 40 is shaped to make it easy to insert glassware in the carrier 10. FIGS. 9–12 show one half of the tab 40 and the glassware with which it cooperates. The tab 40 is, as shown in the other Figures, symmetrical about the plane of the central reinforcing web 30 when the carrier 10 is erected. For clarity only one half of tab 40 is shown and described.

The edge 52 of tab 40 includes a convex central portion 100, a concave portion 102, a rounded corner 104 and a generally straight section 106. The concave portion 102 extends from the central portion 100 and terminates at rounded corner 104. The generally straight section 106 extends from this corner to fold line 46. The edge 52 is specifically shaped to permit an article, such as a glass, to slide over the retaining tab 40 with minimum distortion of the tab, and to retain the glass once it is fully inserted.

FIGS. 9–12 show a series of positions of the retaining tab 40 when inserting a glass 108 with a circular cross section into the carrier 10. In FIG. 9, the glass 108 is shown prior to insertion into the carrier 10. In this initial position the central portion 100 contacts a top edge 110 of the bight 80.

While the glass 108 is being inserted into the carrier (FIG. 10), the retaining tab 40 is pushed downward, thus contacting a bottom edge 112 of the bight, and the glass covers a large portion of the tab half. The shape of the concave edge portion 102 is selected to facilitate insertion of the glass. As the glass 108 is inserted into the carrier 12, the bottom edge 114 of the glass slides along the concave edge portion 102 and presses the retaining tab 40 downward. At the same time the retaining tab 40 may bend slightly. The contour of the edge 52 in general and of the concave edge portion 52 specifically are designed to assure that the retaining tab does not get bent so sharply that it will not spring back to its original planar configuration when the glass 108 has passed into the carrier 10. At the same time the straight sections 106 and rounded corner 104 are shaped and proportioned so that once the glass 108 has been inserted in the carrier 10, the retaining tab 40 engages the side wall of the glass and cannot be overridden by the glass. Thus the contour 52 is selected to ease entrance of a glass into the carrier and to ensure that the glass, once in place, is securely retained.

Figure 11:
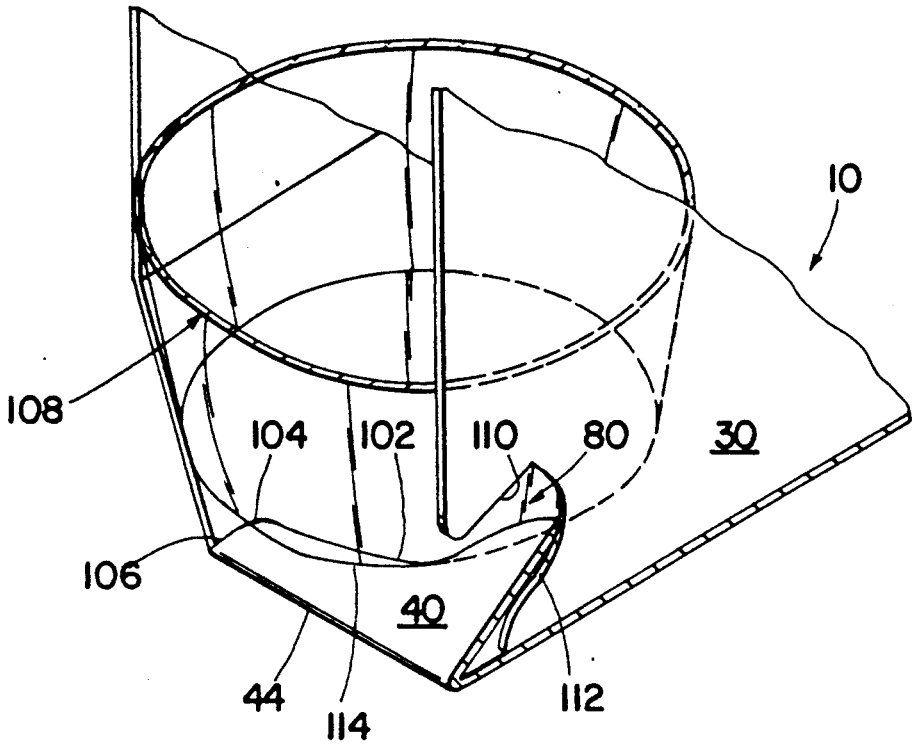
FIG. 11 is a similar illustration with the glass in a position just slightly short of a stored position.
Figure 12:
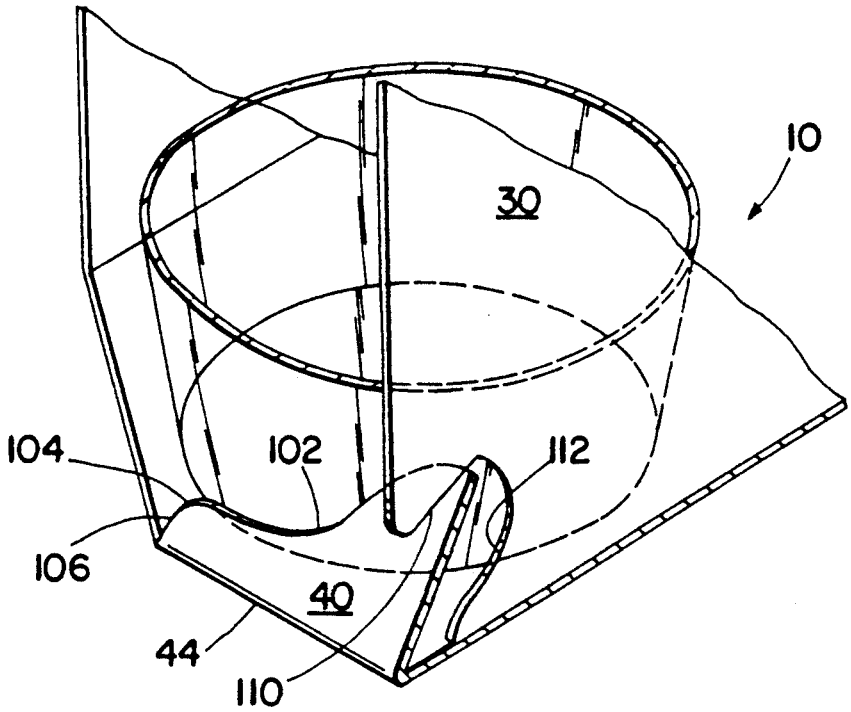
FIG. 12 is a similar view with the glass in stored position.

FIG. 11 shows the tab 40 with the glass in a position just short of a stored position. The tab 40 still contacts the bottom edge 112 of the bight 80, however the glass 108 covers only rounded corner 104 of the tab 40. Once the glass 108 is fully inserted, as shown in FIG. 12, the tab 40 springs back to the position shown in FIG. 9. The tab's central portion 100 then contacts the top edge 110 of the bight 80, and the geometry of the edge 52 retains the glass in this stored position.

Figure 13:
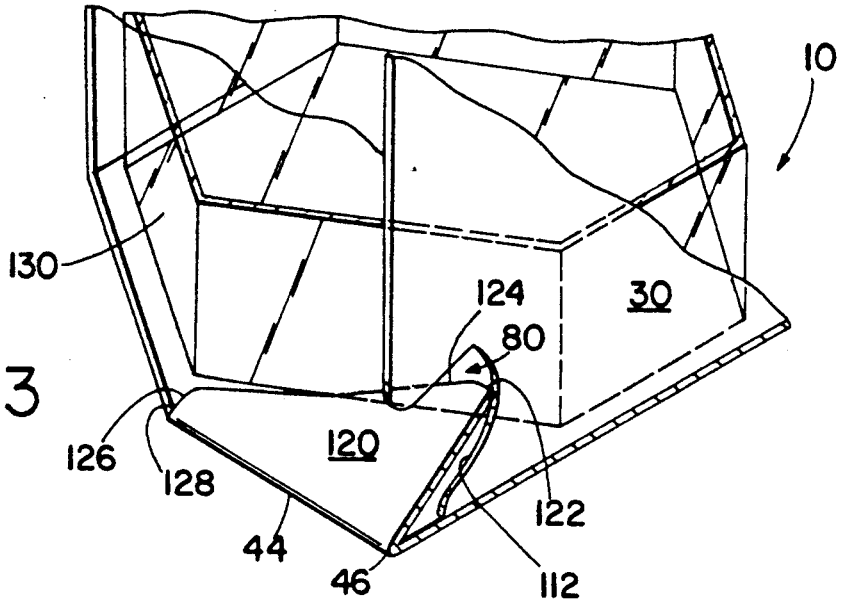
FIG. 13 is a perspective cutaway illustration of part of a carrier having a retaining tab contoured to accommodate a hexagonal-base glass and showing such a glass in a position just slightly short of a stored position.
Figure 14:
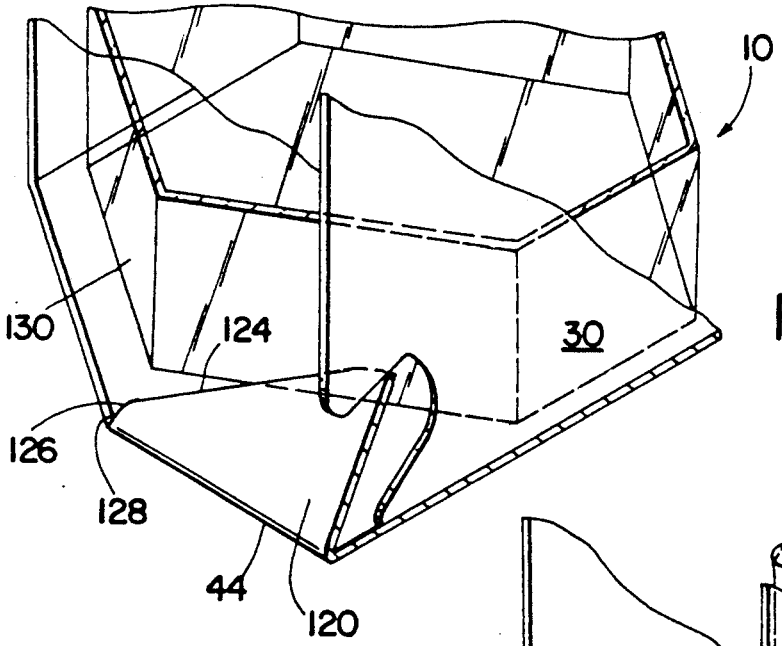
FIG. 14 is a similar view with the glass in stored position.

The retaining tab 40 is shaped to accommodate a carrier for glasses with circular cross sections. However, the present invention may be applied to glassware or articles of other shapes. For example, FIGS. 13 and 14 show a carrier 10 having a different style tab 120, shaped for use with glasses which are hexagonal. For clarity in these Figures only the left half of the tab 120 is shown. The other half is symmetrical with that shown.

The tab 120 includes a central rounded peak 122, and a slanted side 124 extending from the peak. The slanted side 124 terminates at a rounded corner 126. A generally straight section 128 extends from the rounded corner to the fold line 46.

FIG. 13 shows a hexagonal base glass 130 in a position just short of a stored position. The central portion of the tab contacts the bottom edge 112 of the bight 80. The glass 130 covers a corner portion of the tab. The same considerations of facilitating insertion and assuring retention go into the shape of the retaining tab 120 as were discussed above. In this case, however, the point where straight edge 128 joins the fold line 44 is displaced toward the central reinforcing web 30 as compared to the embodiment of FIGS. 1–12. In addition the edge 124 is straight. (FIG. 13 shows the tab 120 slightly bent, so edge 124 appears not to be straight.)

In FIG. 14, the glass 130 is shown in stored position with the central peak 122 contacting the upper edge 110 of the bight 80. Note that the glass 130 may be inserted into the carrier at a variety of angles and then turned to the proper stored position. Once rotated to the proper position the straight edge 124 of the tab 120 engages a side wall of the glass 130 to secure the glass in the carrier 10.

Figure 15:
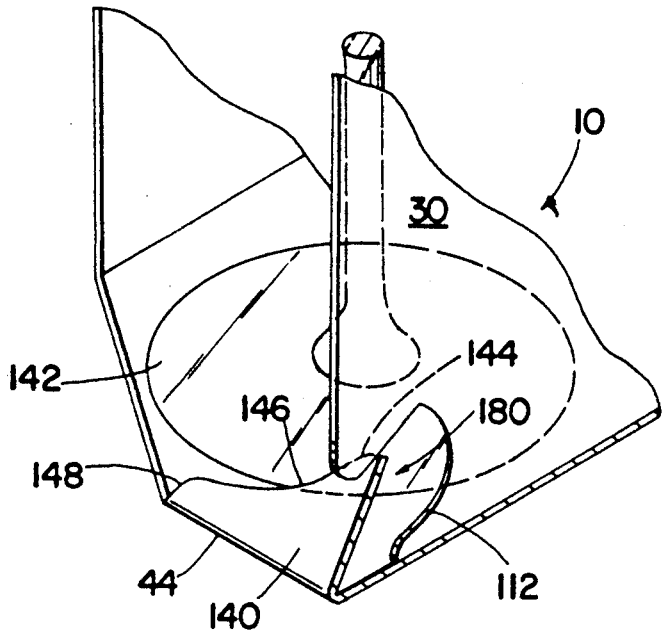
FIG. 15 is a perspective cutaway view of a carrier having a retaining tab contoured to accommodate a stemmed wine glass with a disc shape base, such a glass being shown in a stored position.

FIG. 15 shows a carrier 10 with yet a different style tab 140, which is contoured to fit a stemmed wine glass 142 which has a disc shape base. Again only one half of the tab is shown and described.

The tab 140 has a central rounded peak 144, a concave portion 146 extending from the central peak. The concave portion 146 terminates at rounded corners 148, which extend into fold line 44.

Accordingly, it is clear that the display carrier 10 is substantially easier to use than the prior art display carriers. The carrier 10 is formed from a unitary, planar cardboard blank 12 (FIG. 2) which is die cut and folded in a conventional folding machine to form the carrier 10. The locking tabs 40 and 42 require no manual manipulation because they automatically position themselves as the carrier 10 is erected. The lower retaining tabs 40 are contoured to facilitate insertion without undue stress or distortion of the tab and to assure that the glassware will be securely retained by the tab. The central reinforcing panel has bights 80 and 82 and retaining tabs 40 and 42 which are associated with the respective one of the bights. The retaining tabs 40 and 42 are hinged to the bottom and top panels, 20 and 24, respectively. The retaining tabs 40 and 42 hinge outward in their respective panels and press against the straight surfaces 84 and 86 of the bights 80 and 82, respectively to block any outward movement of a glass inside the carrier. Lift tabs 90 positively elevate the lower retaining tab 40.

What is claimed is:

1. A display carrier folded from a generally flat collapsed condition for shipping and storage to an erect position, said carrier retaining at least a pair of articles in the erect position, said carrier being formed of a flexible material and comprising top and bottom walls;

a pair of side walls, each side wall being hingedly attached to each of said top and bottom walls, to form a carrier sleeve;

a reinforcing wall extending between and hingedly attached to the top and bottom walls;

a planar retaining tab resiliently connected along a fold line to one of the top and bottom walls and having a single contoured edge joining opposite ends of the fold line, the contoured edge having a portion shaped to permit one of such articles to slide over the tab when the carrier is in such erect position and retain such article in place;

the reinforcing wall having a tab-receiving bight at one end portion of the reinforcing wall and adapted to limit rotation of the tab about the fold line in one direction when the carrier sleeve is in the erect position;

each of the articles having a base and a height measured transverse to the base, the height being greater than the distance between the inside of the top wall and said portion of the tab when the tab is rotated to the limit of its rotation in said one direction;

whereby the articles may be received in the carrier in a generally upright orientation with the bases thereof rotating the tab in a direction opposite said one direction as the article is inserted.

2. The carrier of claim 1 wherein the contoured edge includes a convex central rounded portion, two concave portions each extending from the central portion and terminating at a rounded corner, two generally straight sections extending from the rounded corners to the fold line.

3. The carrier of claim 1 wherein the contoured edge includes a central rounder peak, two slanted sides extending from this peak and terminating at a rounded corner, two generally straight sections extending from the rounded corners to the fold line.

4. The carrier of claim 1 wherein said edge includes a central rounded peak, two concave portions each extending from the central portion and terminating at a rounded corner extending into said fold line.

5. The carrier of claim 1 wherein the sleeve is foldable along hinged connections between the top, bottom, side and reinforcing walls between a collapsed condition for storage in which the walls are generally parallel and the reinforcing wall holds the tab flattened against the one of the top and bottom walls to which the tab is connected and an article receiving position in which the tab extends angularly along its fold line toward the interior of the carrier sleeve and abuts the bight in the retaining wall.

6. The carrier of claim 1 including a pair of retaining tabs hinged to opposite edges of one of the top and bottom panels.

7. The carrier of claim 6 wherein the reinforcing wall has a pair of bights, one associated with each of the tabs, and the reinforcing wall adjacent the bights holds the tabs folded flat against their respective top or bottom wall when the carrier is in the collapsed condition.

8. The carrier of claim 1 including four retaining tabs each hinged to an edge of one of the top and bottom retaining walls.

9. The carrier of claim 1 wherein said tab contacts a lower edge of said bight when the article is being slid over said tab, and responds by springing toward an upper edge of said bight once said article is in place to prevent withdrawal of the article from the carrier.

10. A display carrier foldable from a generally flat collapsed condition for shipping and storage to an erect position for retaining at least a pair of articles, said carrier being formed of a flexible material and comprising top and bottom walls;

a pair of side walls, each side wall being hingedly attached to each of said top and bottom walls, to form a carrier sleeve;

a reinforcing wall extending between and hingedly attached to the top and bottom walls;

a planar retaining tab resiliently connected along a fold line to one of the top and bottom walls and having a single contoured edge joining opposite ends of the fold line, the contoured edge being shaped to permit one of such articles to slide over the tab when the carrier is in such erect position and to retain such articles in place;

the reinforcing wall having a tab-receiving bight at one end portion of the reinforcing wall and adapted to limit rotation of the tab about the fold line in one direction when the carrier sleeve is in the erect position; wherein the tab is foldable between a flattened condition for storage and an erect position for retaining articles, the carrier including lift tab means for lifting the tab from its flattened condition as the sleeve is folded from the collapsed condition to the article receiving position.

11. The carrier of claim 10 wherein the tab means is hingedly connected with the bottom wall.

12. The lift carrier of claim 11 wherein the tab means is attached to the central dividing panel.

13. A display carrier foldable from a generally flat collapsed condition for shipping and storage to an erect position for retaining at least a pair of articles, said carrier being formed of a flexible material and comprising top and bottom walls;

a pair of side walls, each side wall being hingedly attached to each of said top and bottom walls to form a carrier sleeve;

a reinforcing wall extending between and hingedly attached to the top and bottom walls;

a pair of planar retaining tabs hinged to opposite edges of one of the top and bottom walls;

each retaining tab being resiliently connected along a fold line to its respective top or bottom wall and having a single contoured edge joining opposite ends of the fold line, the contoured edge being shaped to permit one of such articles to slide over the tab when the carrier is in such erect position and to retain such article in place;

the reinforcing wall having a pair of tab-receiving bights, one associated with each of the tabs and adapted to limit rotation of a tab about the fold line in one direction when the carrier sleeve is in the erect position;

the reinforcing wall adjacent the bights holding the tabs folded flat against their respective top or bottom wall when the carrier is in the collapsed condition; and lift tab means for lifting at least one of the retaining tabs from the folded flat position as the carrier is folded from the collapsed condition to the article receiving position.

14. A display carrier folded from a generally flat collapsed condition for shipping and storage to an erect position, said carrier retaining at least a pair of articles in the erect position, said carrier being formed of a flexible material and comprising top and bottom walls;

a pair of side walls, each side wall being hingedly attached to each of said top and bottom walls to form a carrier sleeve;

a reinforcing wall extending between and hingedly attached to the top and bottom walls;

a planar retaining tab resiliently connected along a fold line to one of the top and bottom walls and having a single contoured edge joining opposite ends of the fold line, the contoured edge being shaped to permit one of such articles to slide over the tab when the carrier is in such erect position and retain such articles in place;

the reinforcing wall having a tab-receiving bight at one end portion of the reinforcing wall and adapted to limit rotation of the tab about the fold line in one direction when the carrier sleeve is in the erect position;

the bight defining a range of folding motion of the tab about the fold line, the tab being movable toward a first limit of its range by contact between the base of an article and a portion of the edge of the tab as the article is being inserted across the tab into the carrier and to a second, opposite limit of its range to resist withdrawal of the article;

the height of the article being greater than the distance between the inside of the top wall and said portion of the tab when the tab is at its second limit.

15. The carrier of claim 14 wherein the tab is contoured to be pressed to one limit of its motion by an article as the article is being inserted into the carrier.

16. A display carrier having an erect position for retaining at least a pair of articles, said carrier being formed of a flexible material and comprising top and bottom walls;

a pair of side walls, each side wall being hingedly attached to each of said top and bottom walls, to form a carrier sleeve;

a reinforcing wall extending between and hingedly attached to the top and bottom walls;

a retaining tab resiliently connected along a fold line to one of the top and bottom walls and having a single contoured edge joining opposite ends of the fold line, the contoured edge being shaped to permit one of such articles to slide over the tab and to retain such articles in the carrier;

the bight in the reinforcing wall receiving the tab, the bight including a first edge for engaging the tab to limit rotation of the tab about the fold line in one direction whereby the tab resists withdrawal of the article from the carrier;

the bight having a second edge spaced from the first edge for limiting rotation of the tab about the fold line in a second direction opposite from said one direction, the tab being pressed against the second edge as an article is inserted into the carrier; and wherein the tab is foldable between a flattened condition for storage and an erect position for retaining articles, the carrier including lift tab means for lifting the tab from its flattened condition as the sleeve is folded from the collapsed condition to the article receiving position.

17. A method of making a carton for storing articles when in an erect position from a longitudinally extending blank having creases defining first, second, third, fourth, fifth, and sixth fold lines, all parallel to each other and transverse to the longitudinal axis of the blank to define a glue flap, and central, overlap, left side, top, right side and bottom panels, a planar retaining tab connected along a fold line to one of the top and bottom panels and having a single contoured edge joining opposite ends of a seventh fold line, the contoured edge being shaped to permit one of such articles to slide over the tab when the carrier is in such erect position and retain such article in place once fully inserted, the central panel having bights formed in the free, longitudinal edges thereof; the method comprising the steps of first folding the retaining tabs about the longitudinal fold lines until a surface of each tab is folded flat against a surface of the central panel, folding the blank about one of the transverse fold lines to bring a surface of the central panel which is adjacent a bight in contact with at least one of the retaining tabs to hold said tab in a folded condition, and thereafter folding the blank about another of the fold lines.

18. The method of claim 17 including the step of gluing the glue flap to one of the panels after folding said blank about said one of said fold lines.

19. The method of claim 18 including holding the areas of the central panel which contact the retaining tabs in tight contact therewith by gluing said glue flap to one of the panels of the blank.

20. The method of claim 19 wherein the step of folding about one of the fold lines includes folding about the third fold line.

21. The method of claim 20 wherein the step of holding the areas of central panel which contact the retaining tabs includes gluing the glue flap to the top panel.

22. The method of claim 21 wherein the step of folding about another of the fold lines includes the step of folding about the fifth fold line.

23. The method of claim 22 including erecting the carton by pressing the third and fifth fold lines toward each other.

24. The method of claim 23 including moving at least one of the top and bottom retaining tabs from its folded flat position to a position in which the retaining tab is angled to the surface from which it extends.

25. The method of claim 24 wherein the step of moving includes lifting a lift tab out of the plane of one of the bottom and top panels as the third and fifth fold lines are pressed toward each other.

26. The method of claim 25 wherein the step of lifting the lift tab includes gluing the lift tab to the central panel.

27. The carton made according to the method of claim 17.

* * * * *